US005445752A

United States Patent [19]

Caporiccio

[11] Patent Number: 5,445,752

[45] Date of Patent: Aug. 29, 1995

[54] HIGH PERFORMANCE GREASES FROM METHYLFLUOROALKYLSILOXANES

[75] Inventor: Gerardo Caporiccio, Milan, Italy

[73] Assignee: Dow Corning Corporation, Midland, Mich.

[21] Appl. No.: 206,369

[22] Filed: Mar. 7, 1994

[30] Foreign Application Priority Data

Sep. 13, 1993 [IT] Italy ..... MI93A01964

[51] Int. Cl.[6] ..... C10M 123/04; C10M 139/04

[52] U.S. Cl. ..... 252/49.6; 252/25; 252/58

[58] Field of Search ..... 252/49.6, 58, 25

[56] References Cited

U.S. PATENT DOCUMENTS

| | | | |
|---|---|---|---|
| 3,061,545 | 10/1962 | Badger . | |
| 3,148,201 | 9/1964 | Fassnacht | 252/49.6 |
| 3,642,626 | 2/1972 | Christian . | |
| 4,582,620 | 4/1986 | Mori et al. | 252/49.6 |
| 5,210,123 | 5/1993 | Caporiccio | 252/49.6 |

*Primary Examiner*—Jacqueline V. Howard
*Attorney, Agent, or Firm*—Roger E. Gobrogge

[57] ABSTRACT

Disclosed are high performance grease compositions containing methylfluoroalkylsiloxanes and solid thickeners containing fluorinated polymers.

16 Claims, No Drawings

HIGH PERFORMANCE GREASES FROM METHYLFLUOROALKYLSILOXANES

BACKGROUND OF THE INVENTION

The present invention relates to greases comprising methylfluoroalkylsiloxanes and solid thickeners containing fluorinated polymers which have excellent lubricating properties.

Greases incorporating certain fluorosilicone polymers are known in the art and several are commercially available. For instance, greases containing poly 3,3,3-trifluoropropylmethyl-siloxane thickened with polytetrafluoroethylene are commercially available from a variety of sources.

Greases containing fluorosilicones with more than 1 perfluorinated carbon atom are also known in the art. For instance, U.S. Pat. No. 3,061,545 teaches greases containing fluorosilicones having repeating units of the structure $RCH_2CH_2R'SiO$ in which R is a perfluoroalkyl radical of 1 to 10 carbon atoms and R' is a monovalent hydrocarbon radical of less than 3 carbon atoms. This reference, however, does not teach fluorinated polymer thickeners.

Similarly, U.S. Pat. No. 3,642,626 describes a grease containing a fluorosilicone polymer thickened with a perfluoropropylene-tetrafluoroethylene copolymer. This reference, however, requires the addition of an antimony dialkyl dithiocarbamate.

The present inventors have now discovered that the greases claimed herein have unexpected lubricating and antiwear properties.

SUMMARY OF THE INVENTION

The present invention relates to a grease composition. The grease contains between 55 and 90 weight percent of a methylfluoroalkylsiloxane of the structure

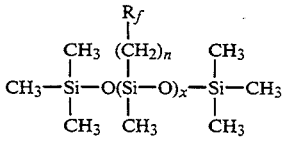

having an average viscosity in the range of from 0.0001 to 0.015 square meters/second, wherein $R_f$ is a perfluoroalkyl group containing 2 to 8 carbon atoms, n is 2 or 3, and the value of x for the components of the average mixture is between 4 and 200. The grease also contains between 10 and 45 weight percent of a solid thickener comprising a fluorinated polymer, provided the fluorinated polymer is not a perfluorpropene-tetrafluoroethylene copolymer.

DETAILED DESCRIPTION OF THE INVENTION

The present invention is based on the unexpected discovery that greases containing methylfluoroalkylsiloxanes having perfluoroalkyl radicals of 2–8 carbon atoms and thickeners containing fluorinated polymers provide improved lubricating properties.

The methylfluoroalkylsiloxanes of the present invention have the structure:

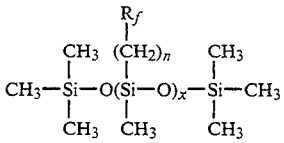

In this structure, $R_f$ is a perfluoroalkyl group containing 2 to 8, preferably 4–6, carbon atoms. n in this structure is 2 or 3 with n=2 being preferred. Finally, this material comprises a mixture of polymers in which the average value of x in this structure is between 4 and 200 with x=10–100 being preferred.

These methylfluoroalkylsiloxanes are generally liquids having a viscosity in the range of from 0.0001 to 0.015 square meters/second. Preferably, the methylfluoroalkylsiloxanes have a viscosity in the range of from 0.00012 to 0.010 square meters/second.

Generally, the methylfluoroalkylsiloxanes are used in the grease preparations in an amount of between 55 and 90 weight percent, with an amount in the range of between 60 and 85 weight percent being preferred.

The above methylfluoroalkylsiloxanes and methods for their preparation are known in the art. For example, they can be prepared by the buffered hydrolysis of methyl fluoroalkyldichlorosilanes in the presence of trimethylchlorosilane followed by a chain extension step comprising heating the siloxanol intermediates at 130°–170° C. under vacuum in the presence of tetramethylguanidine trifluoroacetate. This process is described, for example, in J. Polym. Sci., Polym. Chem., 16, p 1929 (1978).

The methylfluoroalkylsiloxanes are thickened with a material comprising at least a fluorinated polymer thickening agent. Such fluorinated polymer thickening agents are known in the art and most are commercially available. Examples of such agents include polytetrafluoroethylene (PTFE), the copolymer of tetrafluoroethylene and perfluoroalkylvinylether in which the alkyl has 1–3 carbon atoms, the copolymer of vinylidene fluoride and hexafluoroisobutylene, blends of the above polymers, and blends of the above polymers with hexagonal lattice boron nitride (HLBN). One skilled in the art would recognize that other equivalent fluorinated polymers or mixtures thereof would also function herein. When HLBN is used, the copolymer of tetrafluoroethylene and hexafluoropropene can be employed As stated above, fluorinated polymers are known art. For example, the PTFE which may be used herein can include a series of products marketed under the trade name VYDAX TM by E. I. du Pont (Wilmington, Del.). Such polymers may be produced by polymerization of tetrafluoroethylene in the presence of chain transfer agents, such as $CCl_4$, and typically have number average molecular weights up to about 100,000, preferably up to about 50,000. Polymers of this type may be obtained as a dispersion in a fluorocarbon solvent, such as FREON TM F113, or in dry powder form.

Another example of commercial PTFE suitable herein is the polymer obtained by thermal or gamma ray degradation of high molecular weight PTFE or mechanical grinding thereof. Such polymers typically have number average molecular weights on the order of $10^4$ to $10^6$.

Yet another example of commercial PTFE which may be included herein is obtained by emulsion polymerization and subsequent precipitation so as to provide a fine powder. Aggregates of PTFE powder can be readily broken down by passing a liquid suspension of the powder through a two- or three-roll mill. Specific examples of this type of PTFE micro-powder are manufactured by I.C.I. (England), Hoechst (W. Germany), L.N.P. (Malvern, Pa.) and DuPont (Wilmington, Del.).

The copolymer of tetrafluoroethylene and hexafluoropropene can be produced, for example, by the copolymerization of tetrafluoroethylene and hexafluoropropene in the presence of trichloroacetyl peroxide at low temperatures. Such a process is described in U.S. Pat. No. 2,598,283. Other approaches such as emulsion polymerization under conditions described above for PTFE are also generally effective.

The copolymer of tetrafluoroethylene and perfluoroalkylvinylether can be produced, for example, by the copolymerization of tetrafluoroethylene and perfluoroalkylvinylether in aqueous or non-aqueous media. In aqueous copolymerization, water soluble initiators and a perfluorinated emulsifying agent are used. In non-aqueous copolymerization, fluorinated acyl peroxides which are soluble in the copolymerization medium are used as initiators. These processes are described, for example, in U.S. Pat. Nos. 3,132,123, 3,635,926, and 3,536,733.

The vinylidene fluoride-hexafluoroisobutylene copolymer powder which may be used herein is known in the art and may be prepared by methods outlined in U.S. Pat. No. 3,706,723. Generally, this copolymer has a molar ratio of alternating vinylidene fluoride units to hexafluoroisobutylene units of about 1:1. The number average molecular weight of this copolymer is generally at least 50,000 and the melting point is preferably above 300° C. This copolymeric powder generally has an average particle size between 2 and 100 micrometers, preferably between 5 and 50 micrometers.

As noted above, these polymers or copolymers can be mixed with each other or, preferably, mixed with hexagonal lattice boron nitride (HLBN). Generally, the HLBN is mixed in a ratio of HLBN:fluoropolymer thickener of 0.1 to 10, preferably 0.25 to 4. HLBN is known in the art and can be produced, for example, by heating boric oxide and ammonia. HLBN is also commercially available from Kawasaki Steel Corporation. When HLBN is used, the ethylene-propylene fluorinated polymer can be used as stated above.

If used, the hexagonal lattice boron nitride can have nearly any particle size and/or particle size distribution. Preferably, however, the HLBN has a bimodal particle size distribution in which between 25 to 75 weight percent, preferably 40 to 60 weight percent of the powder are aggregate particles having a size of 2–50 micrometers (±20%), preferably 5–15 micrometers (±20%), and a surface area of 1–15 square meters/g, preferably 3–10 square meters/g, and between 75 to 25 weight percent, preferably 60 to 40 weight percent of the powder is fine powder having a size of 0.01 to 1 micrometers (±20%), preferably 0.1 to 0.5 micrometers (±20%), and a surface area of 15–150 square meters/g, preferably 25–90 square meters/g. In addition, however, it is also within the scope of this invention to use only one of the boron nitride powders (i.e., either the aggregate or the fine powder). Particle size determinations can be made by sieving or by counting particles and measuring sizes.

The compositions of the present invention contain between 10 and 45 parts by weight of the thickening agent and between 55 and 90 parts by weight of the methylfluoroalkylsiloxane. Preferably, the compositions of the present invention contain between 15 and 40 parts by weight of the thickening agent and between 40 and 85 parts by weight of the methylfluoroalkylsiloxane. This formulation may, however, be modified by the addition of other components commonly employed in the art which do not change the essential character of the grease such as dispersing or wetting agents, antiwear agents and protective agents for metals.

A suitable surfactant for use in this invention is the class of perfluorinated neutral salts represented by the general formula $R_FAM$, wherein $R_F$ has its above defined meaning, A is a monovalent anionic group selected from $—SO_3^-$ or $—COO^-$ and M is a cation, such as $Na^+$ and $K^+$. Specific examples include $C_7F_{15}COONa$ and $C_8F_{17}SO_3K$. The surfactant, which is generally employed to improve the stability of the grease with respect to phase separation, is typically added in a proportion of 0.1 to 1% by weight of the weight of the thickening agent.

Examples of antirust or metal protecting agents include the following compositions which help protect metal bearing surfaces exposed to aggressive environments:

(1) mixtures of $NaNO_2$, $NANO_3$ and MgO in a ratio of 2 to 20 parts by weight of $NaNO_2$ for 1 part of $NaNO_3$ and 1 part by weight of MgO per 10 to 50 parts of the sodium salts. These mixtures are typically added in a proportion of about 0.01 to 5 parts by weight per 100 parts of the thickening agent.

(2) mixtures of 0.1 to 3 parts by weight of benzotriazole and 0.05 to 5 parts of MgO (optionally in the presence of 0.05 to 1.5 parts by weight of KOH) per 100 parts of thickening agent.

(3) 1 to 2 parts by weight of the barium or zinc salt of a dialkylnaphthalenesulfonic acid, such as dinonylnaphthalenesulfonic acid or dodecylnaphthalenesulfonic acid, per 100 parts of thickening agent.

(4) 0.2 to 2 parts by weight of triphenylphosphine or tripentafluorophenylphosphine per 100 parts of the thickening agent.

(5) 1 to 10 parts by weight of $MOS_2$ as antiwear agent per 100 parts of thickening agent.

(6) 0.5 to 1 part by weight of a heat stabilizer such as an oxide of zinc or calcium or magnesium per 100 parts of thickening agent.

Compositions of the invention may be prepared according to methods used in the art to manufacture conventional polytetrafluoroethylene-thickened greases. Thus, for example, the thickening agent(s) may be mixed with one or more of the above described additives in a low shear mixer, such as a two Z-blade mixer, preferably under vacuum. After any additives employed are well mixed with the thickening agent, the methylfluoroalkylsiloxane is introduced and a homogeneous dispersion obtained by mixing these components at temperatures of about 65° to 80° C. for 2–6 hours. The grease is then allowed to reach room temperature over 2 hours and it is preferably further processed in a three-roll mill (e.g., output gap of 0.05 mm—i.e., the cylinder surfaces in output have a distance of 0.05 mm) to reduce the size of the aggregates and improve the suspension, thus providing a more stable formulation.

The grease compositions of the present invention exhibit exceptionally good anti-wear properties and have a very high resistance to seizure and welding. For example, the greases of the present invention (fluorinated polymer plus methylfluoroalkylsiloxane) avoid seizing and welding under loads of even 750 kg or higher as determined by extreme pressure test ASTM D2596-87. The grease composition which contained fluorinated polymers, HLBN and methylfluoroalkylsiloxane showed even increased load capacities. Moreover, the greases of the invention show a high resistance to high temperature and operate effectively in oxidative or chemically aggressive environments. For example, pressure differential scanning colorimetry (PDSC) under oxygen at 20 MPa showed a flat thermogram and stability up to 280° C.

These results are due to the synergistic effect of the combination of methylfluoroalkylsiloxane liquid and the thickeners described herein and are clearly superior to those of commercial grease formulations.

Similarly, greases containing methylnonafluorohexylsiloxane (viscosity=0.0003 square meters/second) and PTFE (average particle size=3 microns; max=15 microns) in weight ratios of 63/37 were able to pass the extreme Four Ball pressure test of ASTM 2596-87 (room temperature, 1770 RPM) at a load of 800 kg while the equivalent grease formulated with methyl-3,3,3-trifluoropropylsiloxane (viscosity=0.0013 square meters/second) and PTFE showed a welding load in the range of 400–500 kg.

The following Examples are provided so that those skilled in the art will more fully understand the invention.

EXAMPLE 1

A 250 ml stainless steel cylinder mixer equipped with 2 paddles sliding against the wall of the mixer was charged with 80.5 g PTFE (avg. particle distribution=3 microns and bulk density of 300 g/l) and 138 g of polymethylnonafluorohexylsiloxane (viscosity =0.0003 square meters/second). The mixer was operated under a vacuum of 0.665 KPa and 6520 -75° C. for 3 hours. The grease was allowed to cool at room temperature for 3 hours with constant stirring.

The resultant grease appeared very plastic and was easily sheared. The grease was then passed through a 3-roll mill (input gap=0.08 mm and output gap=0.05 mm) 3 times.

The penetration of the grease according to ASTM test method D1403, quarter scale cone, was 327–331 (mm/10).

The grease was also tested under the Shell Four Ball extreme pressure test of ASTM 2596-87 (room temperature, 1770 RPM, 10 seconds). The test did not show any welding for any load from 400 to 800 kg. At 400 kg the average scar diameter was 1.46 mm and at 800 kg the average scar diameter was 1.6 mm.

EXAMPLE 2

Using the same equipment and procedures as Example 1, a grease was formulated from 95 g of PTFE and 170 g of polymethylnonafluorohexylsiloxane (viscosity=0.0013 square meters/second).

The penetration of the resultant grease according to ASTM test method D1403, quarter scale cone, was 324 (mm/10).

The grease was also tested under the extreme Four Ball pressure test of ASTM 2596-87 (room temperature, 1770 RPM, 10 seconds). The grease showed a welding load of 760 kg. At 400 kg the average scar diameter was 1.6 mm.

EXAMPLE 3

Using the same equipment and procedures as Example 1, a grease was formulated from 7 g of boron nitride powder with a particle size of 2–50 microns, 7 g of boron nitride with a particle size of 0.01–1 microns, 35 g of PTFE and 91 g of polymethylnonafluorohexylsiloxane (viscosity=0. 0013 square meters/second).

The grease was tested under the extreme Four Ball pressure test of ASTM 2596-87 (room temperature, 1770 RPM, 10 seconds). At 400 kg the average scar diameter was 1.2 mm.

EXAMPLE 4 (COMPARATIVE)

Using the same equipment and procedures as Example 1, a grease was formulated from 95 g of PTFE and 170 g of polymethyltrifluoroproylsiloxane (viscosity=0.0013 square meters/second).

The grease was tested under the extreme Four Ball pressure test of ASTM 2596-87 (room temperature, 1770 RPM, 10 seconds). At 400 kg the average scar diameter was 2.4 mm.

That which is claimed is:

1. A grease composition comprising:

between 55 and 90 weight percent of methylnonafluorohexylsiloxane having a viscosity in the range of from 0.0001 to 0.015 square meters/second; and between 10 and 45 weight percent of a solid thickener comprising a fluorinated polymer.

2. The grease of claim 1 wherein the methylnonafluorohexylsiloxane has a viscosity in the range of from 0.00012 to 0,010 square meters/second.

3. The grease of claim 1 wherein the methylnonafluorohexylsiloxane is present in an amount of between 60 and 85 wt percent and the thickener is present in an amount of between 15 and 40 weight percent.

4. The grease of claim 1 wherein the fluorinated polymer is selected from the group consisting of polytetrafluoroethylene, a copolymer of tetrafluoroethylene and perfluoroalkylvinylether wherein the alkyl has 1–3 carbon atoms, a copolymer of vinylidene fluoride and hexafluoroisobutylene, a copolymer of tetrafluoroethylene and hexafluoropropene and blends of the above.

5. The grease of claim 1 also containing an agent selected from the group consisting of dispersing agents, antiwear agents and metal protective agents.

6. A grease composition comprising:

between 55 and 90 weight percent of a methylfluoroalkylsiloxane of the structure

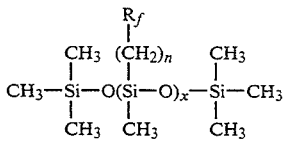

having a viscosity in the range of from 0.0001 to 0.015 square meters/second, wherein $R_f$ is a perfluoroalkyl group containing 2 to 8 carbon atoms, n is 2 or 3, and the value of x for the components of the average mixture is between 4 and 200; and between 10 and 45 weight percent of a solid thickener mixture comprising a fluorinated polymer and boron nitride.

7. The grease of claim 6 wherein the perfluoroalkyl group of the methylfluoroalkylsiloxane contains 4 to 6 carbon atoms.

8. The grease of claim 6 wherein n in the methylfluoroalkylsiloxane structure is 2.

9. The grease of claim 6 wherein the average value of x in the methylfluoroalkylsiloxane structure is between 10 and 100.

10. The grease of claim 6 wherein the methylfluoroalkylsiloxane has a viscosity in the range of from 0.00012 to 0.010 square meters/second.

11. The grease of claim 6 wherein the methylfluoroalkylsiloxane is methylnonafluorohexylsiloxane.

12. The grease of claim 6 wherein the methylfluoroalkylsiloxane is present in an amount of between 60 and 85 wt percent and the thickener mixture is present in an amount of between 15 and 40 weight percent.

13. The grease of claim 6 wherein the fluorinated polymer is selected from the group consisting of polytetrafluoroethylene, a copolymer of tetrafluoroethylene and hexafluoropropene, a copolymer of tetrafluoroethylene and perfluoroalkylvinylether wherein the alkyl has 1 to 3 carbon atoms, a copolymer of vinylidene fluoride and hexafluoroisobutylene, and blends of the above.

14. The grease of claim 6 also containing an agent selected from the group consisting of dispersing agents, antiwear agents and metal protective agents.

15. The grease of claim 6 wherein the weight ratio of boron nitride:fluorinated polymer is in the range of 0.1 to 10.

16. The grease of claim 6 wherein the boron nitride has a bimodal particle size distribution wherein between 25 to 75 weight percent of the powder has a particle size of 2–50 microns and between 75 and 25 weight percent of the powder has a particle size of 0.01–1 microns.

* * * * *